United States Patent [19]

Reiling, Jr. et al.

[11] Patent Number: 4,869,700

[45] Date of Patent: Sep. 26, 1989

[54] TOY COMBINATION RESEMBLING A TRACTOR TRAILER

[75] Inventors: Victor G. Reiling, Jr., West Cornwall; Brian L. Dean, Torrington, both of Conn.; Daniel J. Cooney, Birmingham, Mich.

[73] Assignee: Lionel Trains, Inc., Mt. Clemens, Mich.

[21] Appl. No.: 120,636

[22] Filed: Nov. 13, 1987

[51] Int. Cl.[4] ..... A63H 17/00; A63H 17/05

[52] U.S. Cl. ..... 446/90; 446/95; 446/434; 446/462

[58] Field of Search ..... 446/90, 93–95, 446/434, 462, 471, 464, 431, 465, 470, 290, 291, 289

[56] References Cited

U.S. PATENT DOCUMENTS

| | | | |
|---|---|---|---|
| 3,517,458 | 6/1970 | Sato | 42/88 |
| 3,597,873 | 8/1971 | Fischer . | |
| 3,659,378 | 5/1972 | Tong . | |
| 3,713,247 | 1/1973 | Parrilla | 446/95 X |
| 3,731,428 | 5/1973 | Glass et al. . | |
| 3,740,895 | 6/1973 | Nagasaka . | |
| 3,811,218 | 5/1974 | Salmon . | |
| 3,826,039 | 7/1974 | Disko et al. . | |
| 3,961,440 | 6/1976 | Saito | 446/464 |
| 4,027,421 | 6/1977 | Allen | 446/94 |
| 4,132,028 | 1/1979 | Ogawa . | |
| 4,183,173 | 1/1980 | Ogawa | 446/94 |
| 4,189,864 | 2/1980 | Saito . | |
| 4,217,724 | 8/1980 | Schoenfield et al. | 446/97 |
| 4,248,006 | 2/1981 | Jones et al. . | |
| 4,470,219 | 9/1984 | Sugimoto | 446/464 |
| 4,475,618 | 10/1984 | Kennedy et al. | 180/237 |
| 4,504,239 | 3/1985 | Kulesza et al. | 446/95 |
| 4,565,538 | 1/1986 | Kennedy et al. | 446/427 |
| 4,571,202 | 2/1986 | Diebold | 446/90 |

FOREIGN PATENT DOCUMENTS

| | | | |
|---|---|---|---|
| 2068751 | 8/1981 | United Kingdom | 446/470 |

*Primary Examiner*—Mickey Yu

*Attorney, Agent, or Firm*—Edward J. Timmer

[57] ABSTRACT

The toy combination includes a self-powered toy vehicle with driven wheels adjacent the front thereof and a toy trailer with non-driven wheels and with a receptacle on the trailer in front of its wheels releasably receiving the rear of the toy vehicle. The toy vehicle and trailer include cooperative details for locating and interlocking them together when the rear of the vehicle is received in the receptacle. The toy vehicle and trailer are configured such that the toy combination formed thereby resembles a tractor-trailer type truck whose front wheels comprise the driven wheels of the toy vehicle and whose rear wheels comprise the wheels of the trailer.

28 Claims, 4 Drawing Sheets

FIG. 5
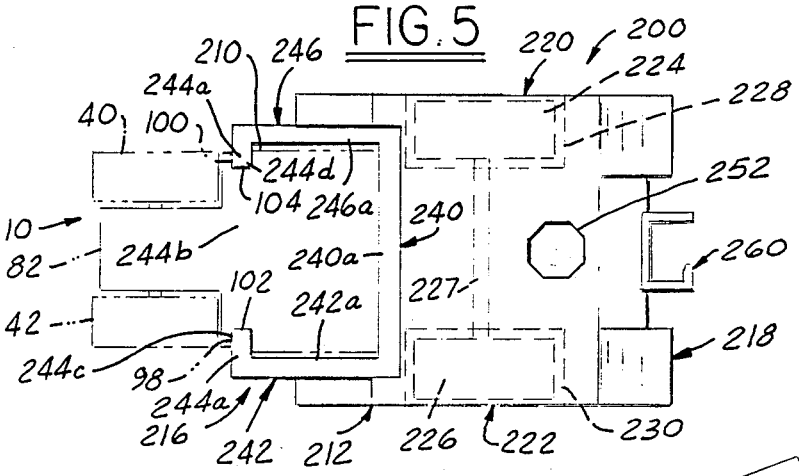
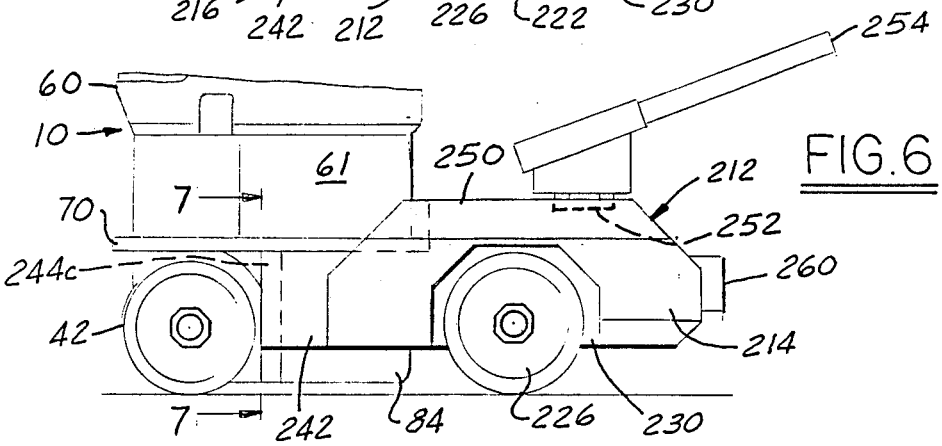
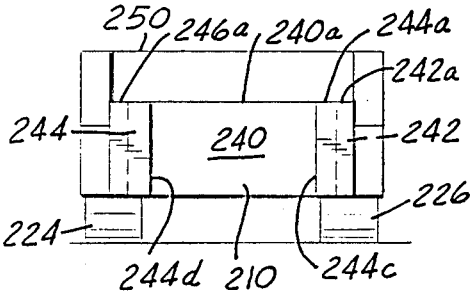
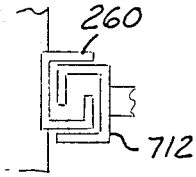
FIG. 9
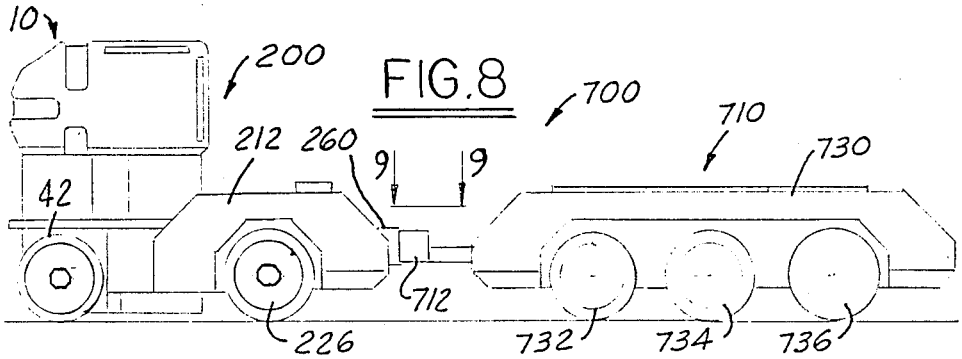

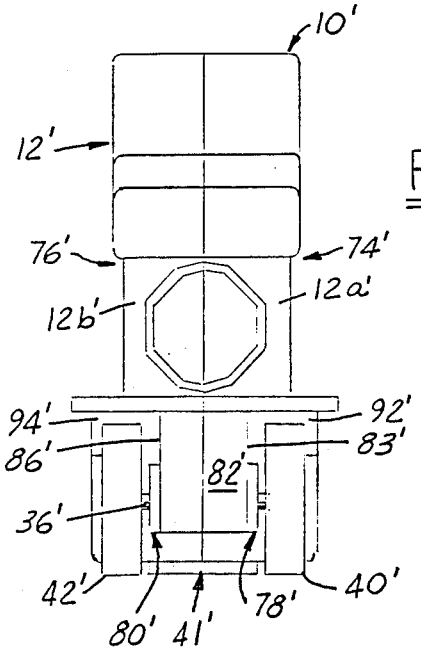
FIG. 10A
FIG. 11
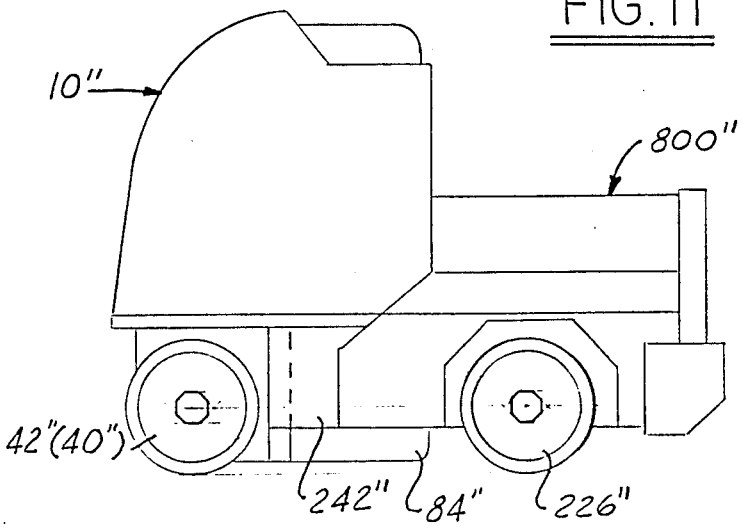

TOY COMBINATION RESEMBLING A TRACTOR TRAILER

FIELD OF THE INVENTION

The invention relates to toy combinations and, in particular, a toy combination including a self-propelled toy vehicle and toy vehicle appendage.

BACKGROUND OF THE INVENTION

The Sato (U.S. Pat. No. 3,517,458 issued June 30, 1970) is directed to a toy vehicle having a detachable auxiliary driving wheel means which permits the toy to be switched from one type of operation to a second kind of operation. The auxiliary wheel means includes two wheels and a transmission to be driven by a motor in the vehicle.

The Fischer (U.S. Pat. No. 3,597,873 issued Aug. 10, 1971) shows a toy construction kit including a series of connectable structural elements using coupling heads and coupling grooves to interconnect pieces. The patent is particularly directed to a non-wheeled drive unit which may be integrally coupled with the structure using such connector elements. The drive unit includes a worm gear for driving purposes.

The Tong (U.S. Pat. No. 3,659,378 issued May 2, 1972) shows a motor driven toy vehicle which may use different vehicle bodies connected to a suitable power module. The power module has an output drive gear to drive the wheels of the vehicle through a driven gear on the axle. The power module is received in the bottom of the vehicle body.

The Glass et al (U.S. Pat. No. 3,731,428 issued May 8, 1973) discloses a toy vehicle having movable auxiliary components on the vehicle which are driven through a gear drive connected to the output of a motor contained in a separate external source of power.

The Nagasaka (U.S. Pat. No. 3,740,895 issued June 26, 1973) shows an amusement device including a plurality of toy figures which may be coupled directly to a two-wheeled vehicle and coupled one on top of each other. The vehicle is in the form of a motorcycle having a front and back wheels with a motor, gear train and battery between the wheels.

The Salmon et al (U.S. Pat. No. 3,811,218 issued May 21, 1974) relates to a modular toy vehicle including various assemblies and sub-assemblies which may be taken apart and reassembled using various coupling means.

The Disko et al (U.S. Pat. No. 3,826,039 issued July 30, 1974) discloses a toy vehicle having plurality of interchangeable shell accessories which are connected to the driven chassis of the toy.

The Ogawa (U.S. Pat. No. 4,132,028 issued Jan. 2, 1979) shows a toy assembly having interchangeable parts and detachable appendages.

The Saito (U.S. Pat. No. 4,189,864 issued Feb. 26, 1980) relates to a self-powered four-wheeled toy vehicle chassis which is capable of sequentially receiving and rejecting a plurality of different types of vehicles bodies.

The Jones et al (U.S. Pat. No. 4,248,006 issued Feb. 3, 1981) is directed to a reconfigurable toy including an electrically driven body section having driven tracks and a plurality of accessories which are interchangeably connected to form various play units.

The Sugimoto (U.S. Pat. No. 4,470,219 issued Sept. 11, 1984) relates to a toy vehicle assembly including a chassis member, a prime mover assembly and a body which are interconnectable to accommodate various different forms of vehicle bodies. The prime mover assembly includes a pair of rear wheels and a spring motor for driving the rear wheels.

The Kennedy et al (U.S. Pat. No. 4,475,618 issued Oct. 9, 1984) shows a power driven four-wheeled toy car having a mechanism for coupling power to the driving wheels. The power source is automatically decoupled when the coupling mechanism is deactivated to permit free rotation of the wheels. An electric motor and gear train are carried between the front wheels while batteries are carried ahead of the front wheels.

The Kulesza et al (U.S. Pat. No. 4,504,239 issued Mar. 12, 1985) discloses a self-propelled power driven land four-wheeled vehicle including a power take-off friction coupling to drive a helicopter shell accessory. The four wheels the land vehicle are exposed when the land vehicle is combined with the helicopter. The land vehicle and helicopter include parrallel rails and channels in engagement to hold them together and a latch and trigger mechanism to release the vehicle from the helicopter.

The Kennedy et al (U.S. Pat. No. 4,565,538 issued Jan. 21, 1986) relates to a toy vehicle having a power take-off which is used to raise or lower a load using a suitable linkage transmission means.

The Diebold (U.S. Pat. No. 4,571,202 issued Feb. 18, 1986) is directed to an electrically powered modular toy set including a motorized main vehicle and accessory unit. The accessory unit is motorized through an electrical connection between the main vehicle and the accessory.

SUMMARY OF THE INVENTION

The invention contemplates a toy combination including a self-propelled toy vehicle and a toy vehicle appendage, such as for example a trailer, having a receptacle for releasably receiving and interlocking with opposite lateral sides of the toy vehicle to form the toy combination. Driven wheels of the self-propelled toy vehicle comprise either the front wheel means or rear wheel means of the toy combination and the non-driven wheels of the vehicle appendage comprise the other of the front wheel means or rear wheel means of the toy combination.

The invention further contemplates a toy combination including a self-propelled toy vehicle and a toy trailer interlocked together to form the toy combination wherein driven wheels of the toy vehicle comprise the front wheels of the toy combination and the wheels of the trailer comprise the rear wheels of the toy combination.

The invention also contemplates a toy combination of the type described in the preceding paragraphs having another toy appendage or trailer coupled thereto.

The invention further contemplates a toy combination of the preceding paragraphs wherein the toy vehicle and toy trailer are configured to form, when interlocked, a toy combination resembling a tractor-trailer type truck having a driver's cab and a lower rear hitch deck or platform.

In a typical working embodiment of the invention, the toy combination includes a self-propelled toy vehicle having a body with a front and rear, driven wheels adjacent the front of the body and an electrical motor and battery to drive the wheels in rotation. The toy combination also includes a toy vehicle appendage in the form of a toy trailer having a trailer body with a front and rear, wheels on the trailer body and a receptacle in front of the wheels for releasably receiving the rear of the toy vehicle behind the driven wheels. The toy vehicle and toy trailer include cooperative details for locating and interlocking them when the rear of the toy vehicle is received in the receptacle of the trailer to form the toy combination. Preferably, the toy vehicle has an upstanding body and the trailer has a flat lower deck to form, when combined, a toy combination resembling a tractor-trailer type truck having a driver's cab and a lower rear hitch deck behind the cab.

In a preferred embodiment of the invention, the receptacle of the trailer is defined by wall means extending forwardly on the trailer for overlaying the opposite lateral sides and rear of the toy vehicle behind its driven wheels when the rear of the vehicle is received in the receptacle of the trailer.

In another preferred embodiment of the invention, the toy vehicle includes a rear compartment on the vehicle body with the compartment having a polygonal cross-sectional or profile. The receptacle on the trailer includes a complementary polygonal cross-sectional or profile to receive the rear compartment.

In still another preferred embodiment of the invention, the cooperative details on the toy vehicle and trailer include a cooperative peripheral shoulder on the vehicle body and peripheral surface on the receptacle and a cooperative mating channel and rib on opposite sides of the vehicle body and receptacle.

BRIEF DESCRIPTION OF THE DRAWINGS

FIG. 5 is a plan view of the toy combination of the invention with the toy vehicle shown in phantom and toy trailer shown in solid.

FIG. 6 is a side elevation of the toy combination of the invention with a weapon on the trailer.

FIG. 7 is a front elevation of the toy trailer shown in FIG. 5.

FIG. 8 is a side elevation of another embodiment of the toy combination that includes another toy trailer coupled to the rear of the toy trailer interlocked to the toy vehicle.

FIG. 9 is a partial plan view in the direction of arrows 9—9 in FIG. 8 showing the coupling.

FIG. 10A is a front elevation of the embodiment of FIG. 10.

FIG. 11 is a view similar to FIG. 6 showing another toy vehicle appendage, such as an engine compartment, interlocked to a reconfigured self-propelled toy vehicle.

BEST MODE FOR PRACTICING THE INVENTION

Figure 1:
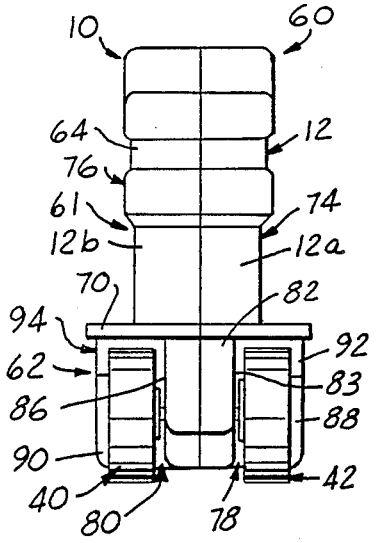
FIG. 1 is a front elevation of a toy vehicle useable in the toy combination of the invention.

Referring to FIGS. 1–4, a self-propelled toy vehicle 10 of the invention is shown including an upstanding body 12 comprised of first and second halves **12*a*,12*b*. Halves 12*a*,12*b*** can be molded plastic and screwed or otherwise joined together in known fashion, although the invention is not so limited.

The body 12 includes inner main chamber 14 formed or defined between walls defining halves **12*a*,12*b* and also and upstanding rear chamber 16 defined by inner walls 18**.

An electrical drive motor 20 is received in main chamber 14 and held in place by ribs 22 integrally molded as part of halves **12*a*,12*b*. The motor drives in rotation a worm 28**.

Walls 18 and ribs 22 as well as other internal walls and features can be molded integrally with halves **12*a*,12*b* of the vehicle body and configured to form desired chambers 14,16 and other features when halves 12*a*,12*b*** are mated and held together.

Worm 28 meshes with worm gear 34 fixtured on transverse rotatable axle 36. Mounted on opposite ends of rotatable axle 36 is a first wheel 40 and second wheel 42. Wheels 40,42 are rotated or propelled by motor 20 through the worm/worm gear drive mechanism and axle 36.

Motor 20 is supplied electrical power from elongated cylindrical battery 46 which may comprise a conventional "AA" dry cell battery having a positive terminal and negative terminal. Battery 46 is disposed in upstanding chamber 16 between metal contacts 50,52. Metal contacts 50,52 engage the positive and negative terminals of the battery, respectively, and are electrically connected to motor 20 through a switch 54 by conventional lead wires (not shown). Switch 54 is mounted on side 76 of body half **12*b* and is accessible from the exterior for actuation. Preferably, the motor is a reversible D.C. motor and switch 54 is a three way or position switch for controlling motor operation to rotate wheels 40,42** in clockwise and counterclockwise directions and also as a shut-off to shut-off the motor when the toy vehicle is not in use.

The toy vehicle 10 includes an outer configuration defining a general mechanical or machine robot shape having a front 58 and rear 59 and an upper head-like portion 60, intermediate waist portion 61 and a lower wheeled portion 62. Head-like portion 60 carries a translucent lens or plate 64 to simulate a visual sensor on the head-like portion. Head-like portion 60 also includes octagonal recesses **60*a*** on opposite sides to releasably receive in friction fit octagonal male protrusions (not shown) on a toy attachment (not shown).

Separating the waist portion 61 and lower wheeled portion 62 is a horizontal flange 70 extending around the periphery of the body 12 above wheels 40,42. Flange 70 projects laterally from the portion 62 normal to the long axis (height) of body 12 to form a laterally extending locating shoulder 72 on its underside for purposes to be explained. Flange 70 preferably is molded integrally with halves **12*a*,12*b*. In lieu of a projecting flange defining shoulder 72, the shoulder 72 may be formed on the opposite first and second sides 74,76 of the vehicle body 12; e.g. by molding the shoulder in or under overhanging portions of sides 74,76**.

As is apparent, opposite first and second sides 74,76 form the lateral sides of the robot between the front 58 and rear 59 thereof. Front side recesses 78,80 are formed in sides 74,76 to receive the wheels 42,40 respectively. To this end, the lower wheeled portion 62 includes a relatively narrow front compartment 82 between the wheels in which compartment the worm 28 and worm gear 34 are disposed as shown in FIGS. 1–4. Front compartment 82 includes opposite parallel sides 83,86 defining a respective recess 78,80.

Behind the narrow front compartment 82 is a relatively large rear compartment 84 in which the lower end of the upstanding battery 46 is disposed. Rear compartment is polygonal, such as rectangular, in cross-section or plan profile.

On the exterior, compartment 84 includes an inner vertical wall 88,90 on opposite sides, each wall 88,90 extending perpendicular to and terminating at raised surfaces (only raised surface 83*a* shown) on sides 83,86, respectively. The raised surface on side 86 is identical to raised surface 83*a*.

Figure 2:
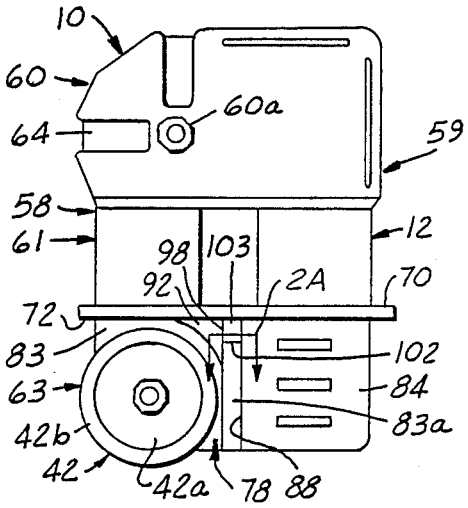
FIG. 2 is a side elevation of the toy vehicle of FIG. 1, the other opposite lateral side being substantially identical.

As shown best in FIG. 2, a wheel cowl portion 92,94 is molded on each front side 83,86, respectively, behind respective wheel 42,40. Each cowl portion 92,94 includes a vertical wall 98,100 in spaced parallel relation to respective walls 88,90 of compartment 84 to define an upstanding, preferably vertical, channel 102,104 on opposite lateral sides 74,76, respectively, to the rear of respective recess 78,80. As is apparent, channels 102,104 are open at the bottom and are closed at the upper end by shoulder 72 with which the channels intersect in a perpendicular manner.

Figure 2A:
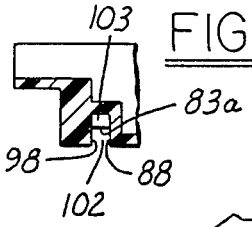
FIG. 2A is a sectional view taken along lines 2A—2A of FIG. 2.
Figure 3:
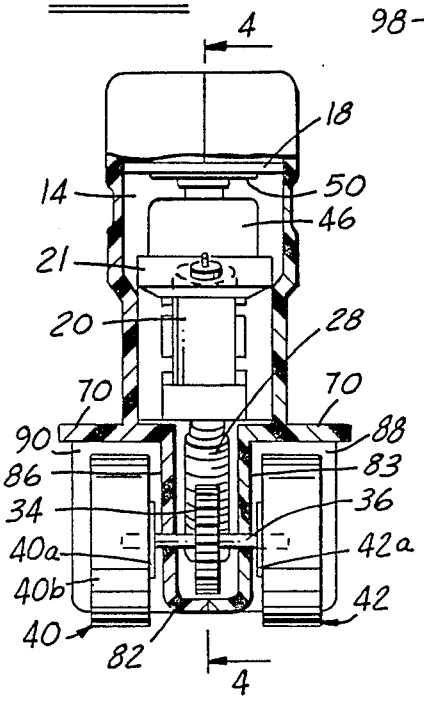
FIG. 3 is similar to FIG. 1 with portions broken away to reveal the motor and drive mechanism as well as battery in the toy vehicle.
Figure 4:
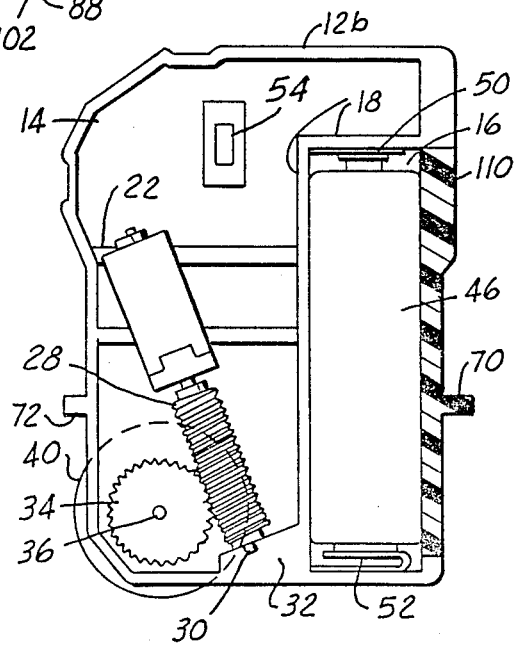
FIG. 4 is a view taken along lines 4—4 of FIG. 3.

As best shown in FIG. 2 and 2A, raised surfaces (only raised surface 83*a* shown) terminate short of shoulder 72 on opposite sides 74,76 to define small recesses (only recess 103 shown) that may receive snap-lock features as explained below.

As will become apparent, flange 70, especially its shoulder 72, provides a first locating and interlocking means on the toy vehicle body. As will also become apparent, channels 102,104 form second locating and interlocking means on the vehicle body.

The rear side of the vehicle body 10 includes a door 110 that closes off the upstanding rear chamber 16 in which the battery is located. Door 110 is snap-fit on the body 10 in conventional fashion.

Wheels 40,42 include an inner rigid hub 40*a*,42*a* with a rubber-like tire 40*b*,42*b* on each hub for purposes to be explained below. Alternately, and preferably, wheels 40,42 may each be one-piece plastic wheels where the hub and tire are integral.

Figure 10:
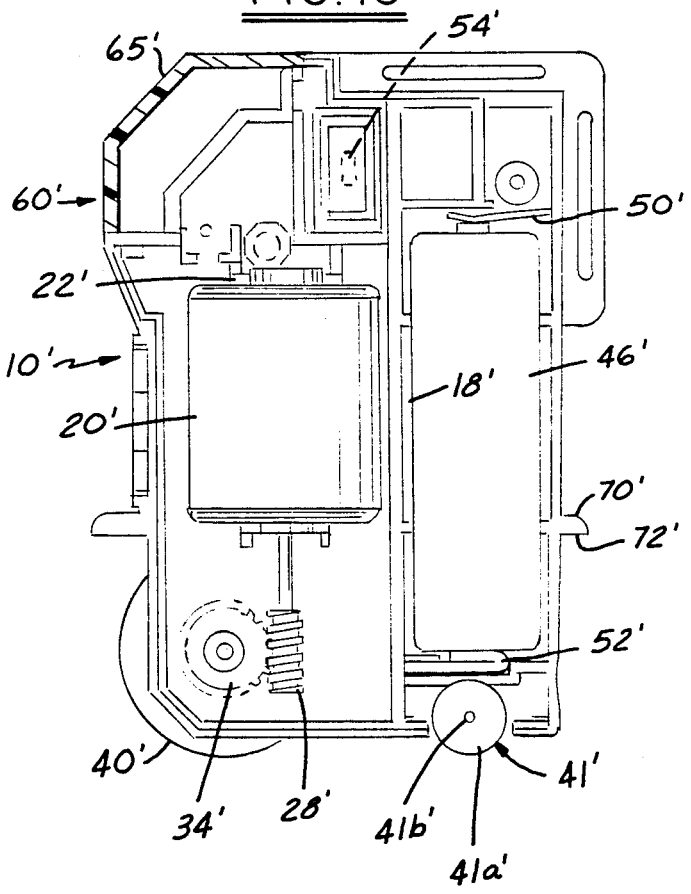
FIG. 10 is a view similar to FIG. 4 of another toy vehicle for use in the toy combination of the invention.

Another embodiment of the toy vehicle is shown in FIG. 10 wherein like reference numerals primed represent like features of FIGS. 1–4. A difference between the embodiment of FIG. 20 and that of FIGS. 1–4 is in the vertical orientation of motor 20' and worm 28' as opposed to the inclined orientation of those components in FIGS. 1–4. Head-like portion 60' is somewhat differently configured and carries a differently configured translucent lenses or cover 65'.

Toy vehicle 10 (or 10') can be used as a separate toy by a child and is movable across a surface simply by actuating switch 54 in either the forward or reverse direction to cause suitable rotation of wheels 40,42 to provide motive power. Although not preferred, the bottom of compartment 84 can drag across the surface as the toy vehicle is moved by rotating wheels 40,42.

Alternatively and preferably, a non-driven freely rotating rear "fifth wheel" 41' shown in FIG. 10 and 10A may be provided on the bottom of compartment 84' to ride on the same surface as wheels 40',42' when they are rotated. Rear wheel 41' may include an elongate roller wheel 41*a* mounted on axle 41*b'* for rotation therewith. Axle 41*b'* is rotatably disposed between body halves 12*a'*,12*b'*. The axis of rotation of axle 41*b'* may be parallel with the axis of rotation of wheels 40',42' on axle 36'. A preferred rear wheel that includes an axle having one axle and pivotable relative to the other axle end depending upon the direction of movement of the vehicle is described in copending application entitled "Toy Vehicle With Pivotable Fifth Wheel" filed in the name of D. Michael Ledyard as inventor and of common assignee herewith, the teachings of which are incorporated herein by reference.

FIGS. 5 and 6 illustrate the toy combination 200 as including the toy vehicle 10 (or 10'') received in a receptacle 210 of a toy trailer 212 as representative of a typical toy vehicle appendage. Toy trailer 212 includes a trailer body 214 which may be molded plastic, although the invention is not so limited. The trailer body 214 includes a front 216 and rear 218 and opposite lateral sides 220,222 between the front and rear as is apparent. Freely rotatable on the trailer body 214 is a pair of non-driven wheels 224,226 mounted on axle 227. Wheels 224,226 are located on respective opposite lateral sides 220,222 in wheel wells 228,230 formed therein.

As shown best in FIGS. 5 and 7, receptacle or pocket 210 is disposed adjacent the front of the trailer body in front of wheels 224,226. The receptacle is defined by four upstanding walls 240,242,244,246. Receptacle 210 has a polygonal shape (in cross-section or plan profile) complementary to that of rear compartment 84. Upstanding walls, 240,242,244,246 include top horizontal locating surfaces 240*a*,242*a*,244*a*,246*a*. Wall 244 includes front opening 244*b* such that wall 244 in effect forms vertical ribs 244*c*,244*d* on the forwardmost end of walls 242,246 in spaced opposing relation at the front of the trailer body.

As is clear from FIG. 5 and 6, surfaces 240*a*,242*a*,244*a*,246*a* are adapted to receive and abut shoulder 72 on flange 70 of the toy vehicle 10(10') when the polygonal rear compartment 84 of the toy vehicle is received releasably in the receptacle 210. Also, vertical ribs 244*c*,244*d* are received and located in channels 102,104 on opposite lateral sides 74,76 of the toy vehicle. Cooperation between locating surfaces 72 and surfaces 240*a*–246*a* as well as engagement of locating ribs 244*c*,244*d* in channels 102,104 serve to locate and interlock the toy vehicle 10 and toy trailer 212 as toy combination 200. It is apparent that the pair of walls 242,246 extend forwardly from the trailer body and overlie the exterior of lateral sides 74,76 behind wheels 40,42 of the toy vehicle; i.e., they overlie the opposite lateral sides of rear compartment 84. Similarly, rear wall 240 overlies the rear of the rear compartment 84 behind wheels 40,42.

As best seen in FIG. 6, the bottom of rear compartment 84 extends through the open bottom of receptacle 210.

It is apparent that the front wheels of the toy combination comprise the driven wheels 40,42 of the toy vehicle and the rear wheels of the toy combination comprise non-driven wheels 224,226 of the toy trailer.

Toy trailer 212 includes a top support deck or surface 250 having a female octagon 252 adapted for friction fit with a toy accessory 254 such as the toy gun shown. When the toy vehicle and toy trailer are united and interlocked a described hereinabove, the toy combination 200 so formed resembles a tractor-trailer type of truck having a driver's cab with a hitch platform behind and below the cab, e.g., see FIGS. 6 and 8. It is apparent that support deck 250 is in a plane coincident in height with the waist portion 61 of the toy vehicle 10(10') so as to create the resemblance to a tractor-trailer type truck.

The rear of the toy trailer includes an integrally molded fixed coupling means 260 recessed in the rear.

FIGS. 8 and 9 show another embodiment of the toy combination 700 of the invention. In particular, the toy combination 700 includes toy vehicle 10(10') and toy trailer 212 comprising previously described toy combination 200 and another toy trailer 710 coupled to the toy trailer 212. Toy trailer 710 includes a coupling 712 to this end. Toy trailer 710 includes trailer body 730 having three pairs of wheels 732,734,736.

Toy trailer 212 and toy trailer 712 are useable as individual toy components with other toy vehicles having compatible coupling means.

Referring to FIG. 6, toy vehicle 10 is shown interlocked with trailer 212 such that the driven wheels 40,42 comprises the front wheels of the resulting toy combination 200 and the non-driven wheels 224,226 of the trailer comprise the rear wheels of the toy combination. Those skilled in the art will appreciate that driven wheels 40,42 of toy vehicle 10 can be rotated to propel the toy combination 200 with the trailer 212 ahead of toy vehicle 10 so that wheels 40,42 constitute rear wheels of the toy combination and non-driven wheels 224,226 constitute the front wheels thereof.

Those skilled in the art will also appreciate that the toy vehicle and toy vehicle appendage 212 can be reconfigured in other forms appropriate to a toy combination having the vehicle appendage as a leading or front portion; e.g., as shown in FIG. 11 where like features are represented by like reference numerals double primed. Toy vehicle 10'' has an engine compartment or hood appendage 800'' coupled thereto and the driven wheels 40'',42'' of vehicle 10'' can be driven in a direction to propel the engine compartment or hood ahead of the vehicle as a forward portion of the toy combination. The driven wheels 40'',42'' in this embodiment would constitute driven rear wheels of the toy combination and the non-driven wheels 226'' of the toy vehicle appendage 800'' would constitute the front wheels of the toy combination.

While the invention has been described by a detailed description of certain specific and preferred embodiments, it is understood that various modifications and changes can be made therein within the scope of the appended claims which are intended to include equivalents of such embodiments.

What is claimed is:

1. A toy combination comprising:

(a) a self-propelled toy vehicle having a body with opposite lateral sides, driven wheel means on the body and motor means for driving the wheel means, (b) a toy vehicle appendage having a body with non-driven wheel means thereon and with wall means adjacent an end of the appendage body for defining a receptacle thereon for releasably receiving the opposite lateral sides of the toy vehicle, (c) means on said toy vehicle and toy vehicle appendage for locating and interlocking the toy vehicle and the toy vehicle appendage when the opposite lateral sides are received in the receptacle to form a toy combination whose front wheel means comprises one of said driven wheel means or said non-driven wheel means and whose rear wheel means comprises the other of said driven wheel means or said non-driven wheel means, said driven wheel means propelling said toy combination across a surface, and (d) said means for locating and interlocking the toy vehicle and toy vehicle appendage comprising (1) a peripheral shoulder on the opposite lateral sides of the toy vehicle and a surface on said wall means adapted to abut the shoulder and (2) a channel on each opposite lateral side of said toy vehicle beneath said shoulder and a rib on said wall means of said toy vehicle appendage beneath said surface for mating in a respective channel.

2. The toy combination of claim 1 wherein the wall means overlies said opposite lateral sides and a rear of the toy vehicle when the lateral sides are received in the receptacle.

3. The toy combination of claim 1 wherein the body of the toy vehicle includes a rear compartment behind the driven wheel means and having a polygonal profile.

4. The toy combination of claim 3 wherein the receptacle is disposed adjacent a front of the toy vehicle appendage and includes a polygonal profile complementary to that of the rear compartment for releasably receiving same.

5. The toy combination of claim 1 wherein the receptacle includes opposite lateral sides formed by a pair of spaced apart wall means extending forward from the appendage body and said wall means each have said rib on the forwardmost end thereof.

6. The toy combination of claim 1 wherein the mating channel and rib extend transverse to the shoulder.

7. The toy combination of claim 1 wherein mating channel and rib extend substantially perpendicular to the shoulder.

8. The toy combination of claim 1 wherein the toy vehicle appendage includes coupling means on the rear for coupling to another toy vehicle.

9. The toy combination of claim 1 wherein the toy vehicle appendage comprises a trailer with a support deck behind the receptacle and above the wheel means thereof.

10. The toy combination of claim 8 further including another toy trailer coupled to the coupling means.

11. A toy combination comprising:

(a) a self-propelled toy vehicle having an upstanding body with a front and rear and opposite lateral sides between the front and rear, a pair of driven wheels adjacent the front and means on the body for driving the wheels in rotation, (b) a toy trailer having a trailer body with a front and rear, a pair of wheels on the trailer body, wall means adjacent the front of the trailer body for defining a receptacle in front of the wheels thereon for releasably receiving the rear of the toy vehicle behind the driven wheels, (c) means on said toy vehicle and toy trailer for locating and interlocking the rear of the toy vehicle and wall means of the toy trailer when the rear is received in the receptacle to form a toy combination whose front wheels comprise the driven wheels of the toy vehicle and whose rear wheels comprise the wheels of the toy trailer, and (d) said means for locating and interlocking the rear of the toy vehicle and the wall means of the toy trailer comprising a channel on each opposite lateral side of said toy vehicle and a rib on said wall means of said toy trailer for mating in a respective channel.

12. The toy combination of claim 11 wherein opposite lateral sides of the receptacle are formed by a pair of spaced apart wall means extending forward from the trailer and said wall means each intersect a respective rib on the forwardmost end thereof.

13. The toy combination of claim 11 wherein the toy trailer includes a support deck behind the receptacle and above the wheel means thereof.

14. The toy combination of claim 11 wherein the toy trailer includes coupling means adjacent the rear and another toy trailer is coupled thereto.

15. The toy combination of claim 11 wherein the toy trailer includes a support deck above the wheels of the trailer and below the uppermost portion of the upstanding body when they are combined so that the toy combination resembles a tractor-trailer type truck.

16. The toy combination of claim 11 wherein the toy trailer includes a support deck and wherein the upstanding body includes a lower wheeled portion having the driven wheels thereon, an upper portion and an intermediate waist portion, said support deck being at the level of the waist portion when the rear is received in the receptacle so that the toy combination resembles a tractor-trailer type of truck.

17. The toy combination of claim 11 wherein the wall means overlies the lateral sides and rear of the toy vehicle behind the driven wheel means when the rear is received in the receptacle.

18. The toy combination of claim 11 wherein the body of the toy vehicle includes a rear compartment behind the driven wheels and having a polygonal profile.

19. The toy combination of claim 18 wherein the receptacle includes a polygonal profile complementary to that of the rear compartment for releasably receiving same.

20. The toy combination of claim 11 wherein said means for locating and interlocking includes a peripheral flange around the body of the toy vehicle and a surface on said wall means adapted to abut the flange.

21. The toy combination of claim 20 wherein the mating channel and rib extend transverse to the flange.

22. The toy combination of claim 21 wherein mating channel and rib extend substantially orthogonal to the flange.

23. A toy combination comprising:

(a) a self propelled toy vehicle having an upstanding body with a front and rear and opposite lateral sides between the front and rear, a pair of driven wheels adjacent the front, means for driving the wheels in rotation, a shoulder on the body around its periphery above the wheels and means on the body for forming an upstanding channel on a respective one of the opposite lateral sides behind a respective wheel and below the shoulder, and (b) a toy trailer having a trailer body with a front and rear, a pair of wheels on the trailer body, wall means adjacent the front of the trailer body for defining a receptacle in front of the wheels for releasably receiving the rear of the toy vehicle behind the wheels, said wall means having a surface on which the shoulder rests and having a rib on each side of the receptacle adjacent a respective opposite lateral side of the toy vehicle with each rib received in a respective one of the channels whereby the toy vehicle and toy trailer are located and interlocked relative to one another to form a toy combination whose front wheels comprise the driven wheels of the toy vehicle and whose rear wheels comprise the wheels of the toy trailer and resembling a tractor-trailer type truck.

24. The toy combination of claim 23 wherein the wall means overlies the lateral sides and rear of the toy vehicle behind the driven wheel means when the rear is received in the receptacle.

25. The toy combination of claim 23 wherein the body of the toy vehicle includes a rear compartment behind the driven wheels and having a polygonal profile.

26. The toy combination of claim 25 wherein the receptacle includes a polygonal profile complementary to that of the rear compartment for releasably receiving same.

27. The toy combination of claim 23 wherein the toy trailer includes a coupling means on the rear of the trailer for operatively coupling to another toy vehicle.

28. The toy combination of claim 27 further including another toy trailer coupled to the toy trailer.

* * * * *

UNITED STATES PATENT AND TRADEMARK OFFICE

CERTIFICATE OF CORRECTION

PATENT NO. : 4,869,700

DATED : September 26, 1989

INVENTOR(S) : Victor G. Reiling, Jr. et al.

It is certified that error appears in the above-identified patent and that said Letters Patent is hereby corrected as shown below:

Column 5, line 58, delete "lenses" and insert --lens-- therefor.

Column 6, line 16, delete "(or 10")" and insert --(or 10')-- therefor.

Signed and Sealed this

Tenth Day of August, 1993

*Attest:*

Michael K. Kirk

MICHAEL K. KIRK

*Attesting Officer*

*Acting Commissioner of Patents and Trademarks*